US005303904A

United States Patent [19]

Kemp

[11] Patent Number: 5,303,904

[45] Date of Patent: Apr. 19, 1994

[54] METHOD AND APPARATUS FOR CONTROLLING HEAT TRANSFER BETWEEN A CONTAINER AND WORKPIECES

[75] Inventor: Willard E. Kemp, Houston, Tex.

[73] Assignee: Fike Corporation, Blue Springs, Mo.

[21] Appl. No.: 911,062

[22] Filed: Jul. 9, 1992

Related U.S. Application Data

[63] Continuation-in-part of Ser. No. 763,339, Sep. 20, 1991, which is a continuation-in-part of Ser. No. 467,050, Jan. 18, 1990, abandoned.

[51] Int. Cl.[5] ..... F27B 15/00

[52] U.S. Cl. ..... 266/252; 148/630; 432/58

[58] Field of Search ..... 266/172, 249, 252, 254; 148/276, 630; 432/58, 15

[56] References Cited

U.S. PATENT DOCUMENTS

| | | | |
|---|---|---|---|
| 2,987,352 | 6/1961 | Watson | 308/241 |
| 3,053,704 | 9/1962 | Munday | 148/630 |
| 3,197,328 | 7/1965 | Jung et al. | 148/630 |
| 3,369,598 | 2/1968 | List | 432/58 |
| 3,401,923 | 9/1968 | Bearce | 432/58 |
| 3,408,236 | 10/1968 | Van Hartesvelot | 148/6.3 |
| 3,492,740 | 2/1970 | Geipel et al. | 432/15 |
| 3,615,885 | 10/1971 | Watson et al. | 148/6.3 |
| 3,630,501 | 12/1971 | Shabaker | 263/52 |
| 4,141,759 | 2/1979 | Pfistermeister et al. | 148/6.35 |
| 4,154,574 | 5/1979 | Keirle et al. | 432/58 |
| 4,193,758 | 3/1980 | Peterson et al. | 432/27 |
| 4,474,553 | 10/1984 | Takahashi | 432/27 |
| 4,478,648 | 10/1984 | Zeilinger et al. | 148/630 |
| 4,547,228 | 10/1985 | Girrell et al. | 148/630 |
| 4,623,400 | 11/1986 | Japka et al. | 148/6.11 |
| 4,637,837 | 1/1987 | Von Matuschka et al. | 148/630 |
| 4,671,824 | 6/1987 | Haygarth | 148/630 |
| 4,853,024 | 8/1989 | Seng | 432/197 |

FOREIGN PATENT DOCUMENTS

| | | | |
|---|---|---|---|
| 0555952 | 4/1958 | Canada . | |
| 0315975 | 5/1989 | European Pat. Off. | 148/630 |
| 56-146875 | 11/1981 | Japan . | |

OTHER PUBLICATIONS

"Corrosion of Zirconium and Zircaloy-2", L. Anderson et al, Electrochemical Technology, vol. 4, No. 3-4, pp. 157-162, Apr. 1966.

Paper Entitled "Improved Wear Resistance of Zirconium By Enhanced Oxide Films" By John C. Haygarth & Lloyd J. Fenwick Presented Apr. 9-13, 1984.

Brochure of Teledyne Wah Chang Albany, Aug. 1990, Article By Willard E. Kemp Entitled "Nobleizing: Creating Tough, wear resistant surfaces on zirconium", pp. 4, 5, and 8.

*Primary Examiner*—Scott Kastler

*Attorney, Agent, or Firm*—Bush, Moseley & Riddle

[57] ABSTRACT

An apparatus for transferring heat between workpieces and a container (10, 10A). The container (10, 10A) has particulate material (28) occupying a substantial portion of the volume of the container (10, 10A) and the container (10, 10A) is rotated to fluidize the particulate material which contacts the workpieces (30) for transferring heat between the container (10, 10A) and the workpieces (30). The container (10, 10A) is enclosed to provide a sealed volume within the container (10, 10A). A predetermined gas may be provided through an inlet (17, 31A) to the container (10, 10A) and gas may be exhausted from an outlet (16, 133A) from the container (10, 10A). The container may either be heated or cooled as desired.

10 Claims, 4 Drawing Sheets

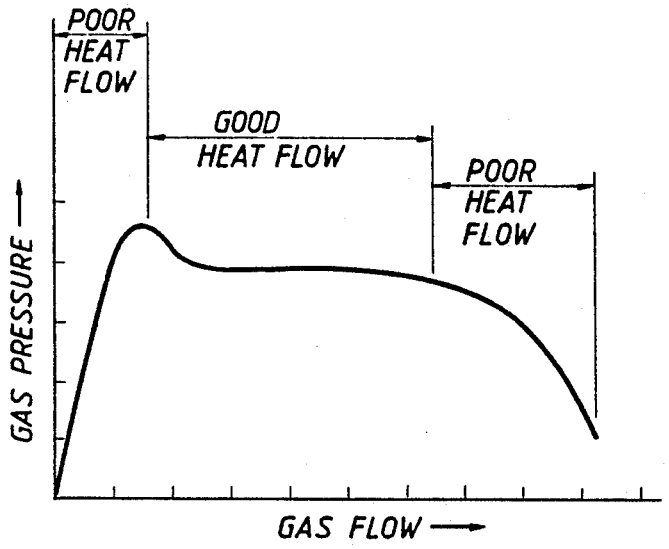
FIG. 1
FIG. 2
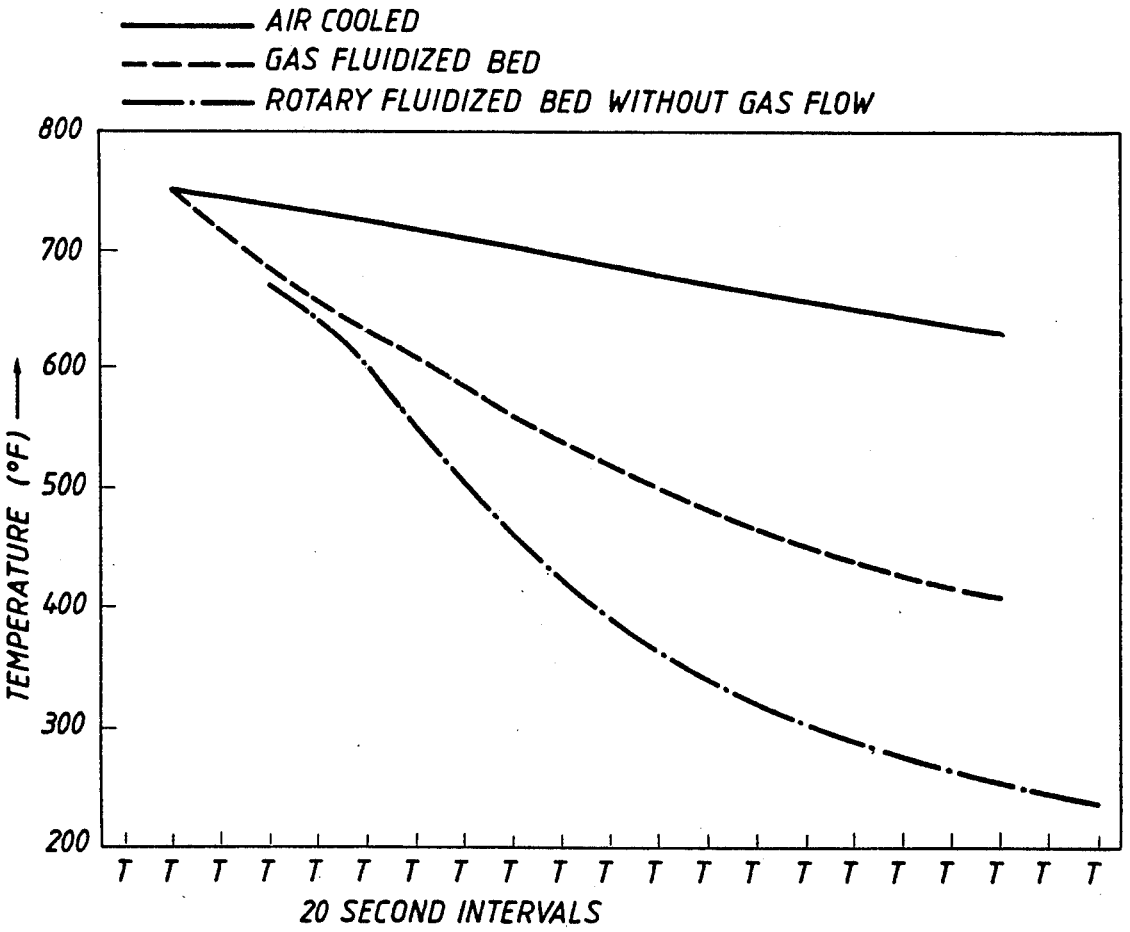

FIG. 4
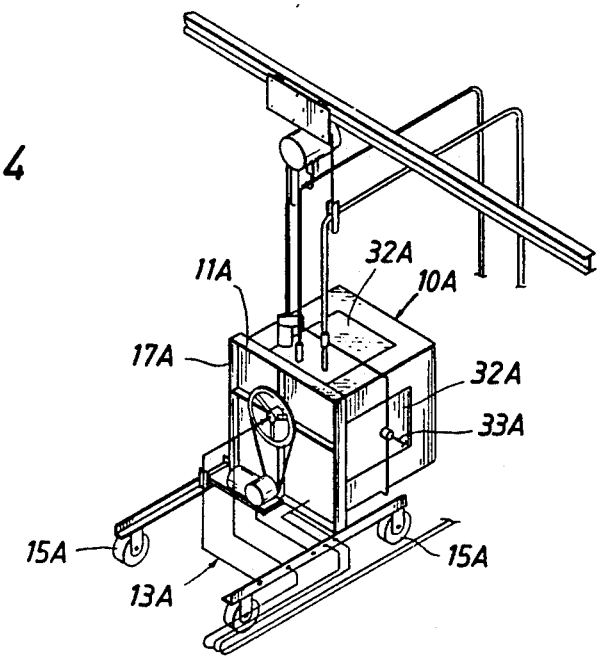
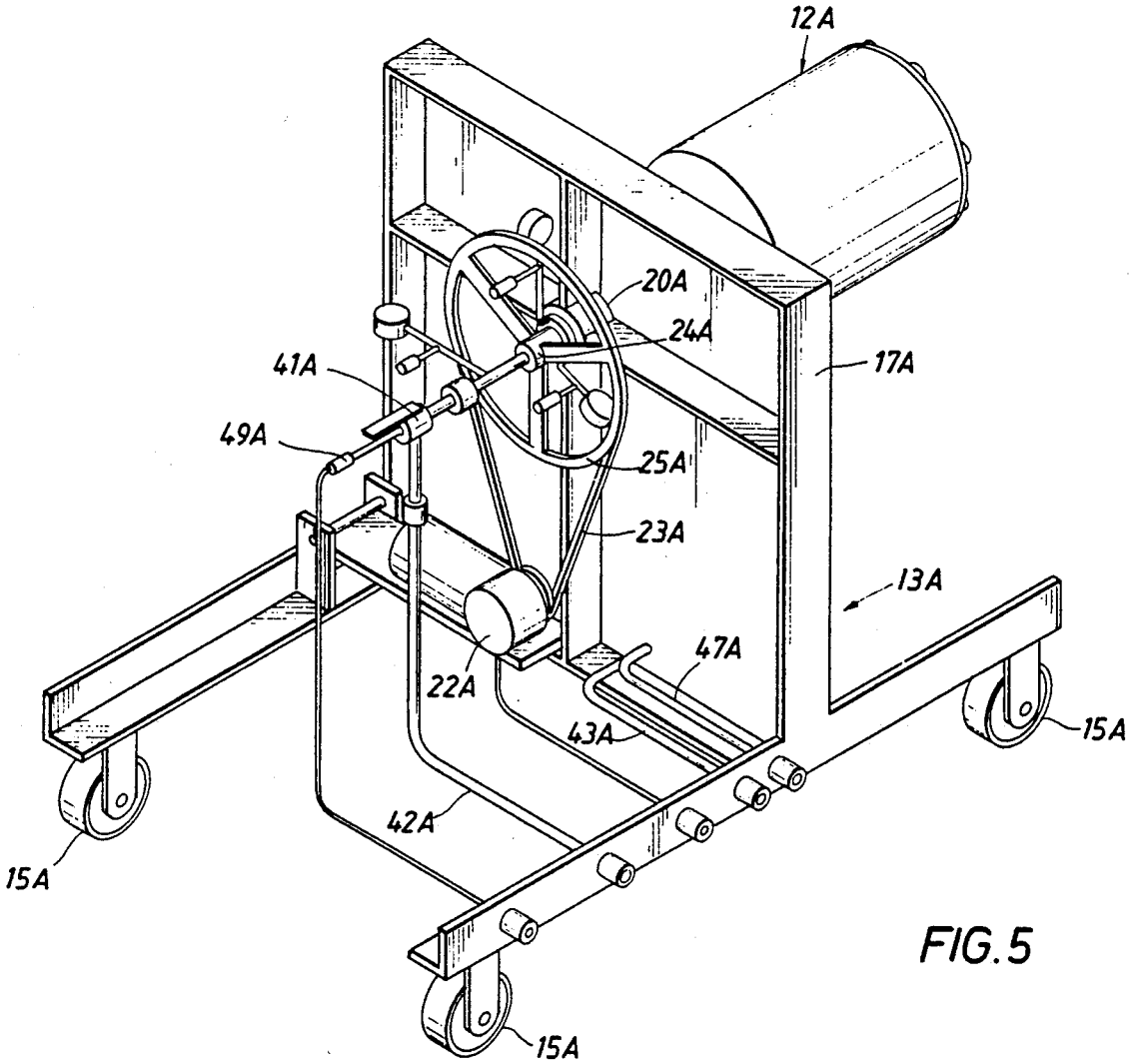
FIG. 5

METHOD AND APPARATUS FOR CONTROLLING HEAT TRANSFER BETWEEN A CONTAINER AND WORKPIECES

REFERENCE TO RELATED APPLICATIONS

This application is a continuation-in-part of pending application Ser. No. 763,339 field Sept. 20, 1991, which is a continuation-in-part of application Ser. No. 467,050 field Jan. 18, 1990, abandoned.

FIELD OF THE INVENTION

This invention relates to a method and apparatus for controlling heat transfer between a container and workpieces therein, and more particularly to such a method and apparatus in which the container is mechanically moved and has fine particulate material therein contacting the workpieces for the transfer of heat between the workpieces and the container.

BACKGROUND OF THE INVENTION

It is necessary to heat workpieces for various processes utilized in treating the workpieces, such as for example, processes utilized for hardening the outer surfaces of the workpieces. Workpieces have been heated heretofore by a fluidizing process in which the workpieces have been immersed in finely divided particles or particulate material in a fixed container and a gas passed through the finely divided particles to provide fluidizing of the particles about the workpieces for effecting heating of the workpieces in the fixed container. The fluidizing of the particles causes a random movement of the particles and a rubbing action of the particles against the outer surface of the workpieces to effect a transfer of heat between the particles and the workpieces. The utilization of very fine particles provides a large surface area for heating and the heat is normally provided from the wall of the fixed container in which the particles and workpieces are positioned for the heat treatment.

Heretofore, workpieces have also been positioned within a container having abrasive material therein for contacting the workpieces with the container being rotated in a tumbling action. The rotation of the container causes movement of the abrasive material and workpieces during the tumbling action to provide a desired surface finish to the workpieces. However, the container has not been heated and the abrasive material has not been utilized for transferring heat between the workpieces and the container. Also, abrasive materials utilized in rotating containers heretofore has not been of a sufficiently small particle size such as less than around 800 microns, for fluidizing from rotation of the container to transfer heat effectively between the workpieces and the container.

Gas has been commonly employed in a fixed container for fluidizing particulate material by flowing through the particulate material from the bottom to the top. Advantages of utilizing a fluidized bed for heating of a workpiece such as by treating the outer surface of the workpiece to obtain a hardened outer case include the following: (1) heat transfer is more uniform than in an air furnace; (2) contamination is minimized as the fluidized bed material and gas can be independently controlled; (3) the rate of heating and cooling can be controlled by cycling fluidization action on and off; (4) the furnace can be shut down and restarted without fear of thermal shock; (5) the workpiece can be exposed to a desired gas mixture for precise periods of time and temperature; and (6) the bed can be of materials which are inert to the workpiece so all the reactive elements are provided from the injected gases.

SUMMARY OF THE INVENTION

The present invention is particularly directed to a method and apparatus for controlling heat transfer having a container and workpiece therein immersed in a particulate material of small particle size with the container mechanically moved to provide a random movement of the particles and workpieces for effecting fluidizing of the particles to enhance or increase the heat transfer between the container and the workpieces. The small particles, such as beads, are preferably of a material softer than the material forming the workpieces so that any abrasive action between the workpieces and particulate material is minimized. The particulate material is of a sufficient volume to cover substantially the entire surface area of the workpieces during a single cycle or rotation of the container and the small particle size provides a large surface area for contacting the outer surface of the workpieces for transferring heat. The rubbing of the small particles against the surface area of the workpieces may also provide a relatively smooth surface for the workpieces. The constant motion of the fluidized particles against the workpieces maintains a new and fresh unoxidized surface material available for reaction with any gases present in the container. The container is enclosed to permit the entry and exit of a predetermined gas, if desired, and to provide a controlled atmosphere within the container for a predetermined negative or positive pressure, as desired.

The heat transfer method and apparatus of the present invention is particularly useful for the surface hardening of workpieces made from refractory metals or metal alloys containing refractory metals. The container may preferably hold the workpiece in a bed of metallic oxide granules which will consist primarily of oxides of the metal from which the workpiece is formed.

A metal retort or container holds the workpiece in a bed of particulate material which desirably will consist primarily of oxides of the metal from which the workpiece is formed. The bed is rendered into a liquid-like state by the slow and uniform movement from a mechanical agitation of the bed. Using as a bed material a metallic oxide of the same material as the workpiece eliminates most potential for diffusion of unwanted ions from the bed into the workpiece. In the desirable fluidization range, heat transfer is very much higher that an air furnace and uniformity of heating is assured under precise controls. Above the desirable rate of particle movement in the fluidized bed, the rate of heat transfer is significantly reduced. Below the desirable rate of particle movement, heat transfer is also very low. If agitation is absent, the bed will act as an insulator. It should be noted that in a fluidized bed, gas flow or agitation merely dislodges the particles and gas or the type of gas does not effect heat transfer since the heat transfer function is independent of the gas. The heat transfer function is affected by the rate of particle movement and is greatest when the particles are in a true fluid-like state, whether that state is achieved through gas flow or mechanical agitation.

Fluidization of the bed in the present invention is accomplished by mechanical movement of the container and particularly rotation of the container. This is desirable in that it reduces or eliminates the need for input gases. The bed material may be selected from any group of materials which have the desired shape and durability and can be selected from materials which are non-reactive with the workpiece metal. In some cases the bed may have particles which will react with oxygen to a greater degree than the workpiece metal so as to remove oxide which may exist on the surface of the workpiece.

Workpieces are preferably placed in a rotating container with particulate particles and tumbled within the rotating container. Working of the surface reduces the grain sizes in workpieces, such as zirconium workpieces, by a factor of at least 3 and sometimes a reduction as high as 20 or 30 times is possible. When subsequent nitriding or oxidizing operations are employed, the grain recrystallizes, and sometimes will then grow or increase to a size larger than the initial size prior to working. Under certain conditions, it may be desirable to nitride the outer surface of a workpiece, such as zirconium, prior to any oxidizing.

Nitriding operations involving titanium, for instance, are generally carried out at a temperature of 800 F. to 1500 F. The temperature is selected to be at least below that temperature at which phase changes or dramatic grain growth would take place. Nitriding and oxidizing temperatures for other alloys can be substantially different. For example, satisfactory oxidation of tantalum can take place at around 800 F.; nitriding between 1300 F. and 1600 F.; oxidizing of zirconium from 800 F. to 1600 F.; and nitriding of titanium from 800 F. to 1700 F. However, the process and apparatus for carrying out the process are generally similar except for such factors as the temperature, the time periods for heating and cooling, the precise gases utilized, and the type of metal particles used in the fluidizing bed.

An object of this invention is to provide an apparatus and method for transferring heat between a container and workpieces embedded in particulate material in the container by movement of the container to effect fluidizing of the particulate material.

Another object is to provide such an apparatus and method in which fluidization of the particulate material about the workpieces in the container is obtained by movement of the container such as by rotation or oscillation.

Another object is to provide such an apparatus and method transferring heat between the container and workpieces for hardening the outer surface of refractory metal workpieces by oxidizing or nitriding the surface of the workpieces to provide a hardened outer case.

Other objects, features, and advantages of this invention will become more apparent after referring to the following specification and drawings.

BRIEF DESCRIPTION OF THE DRAWINGS

FIG. 1 is a graph showing the interrelationships between gas flow, gas pressure, and heat transfer;

FIG. 2 is a graph comparing the heat transfer rate of the present invention utilizing a rotary container with gas fluidizing and ambient air cooling;

FIG. 4 is a perspective of another embodiment of the heat transfer apparatus of this invention in which a movable rotary container is adapted for fitting within a fixed heating compartment;

FIG. 5 is an enlarged new perspective of the rotary container of the apparatus shown in FIG. 4.

DESCRIPTION OF THE INVENTION

Figure 3:
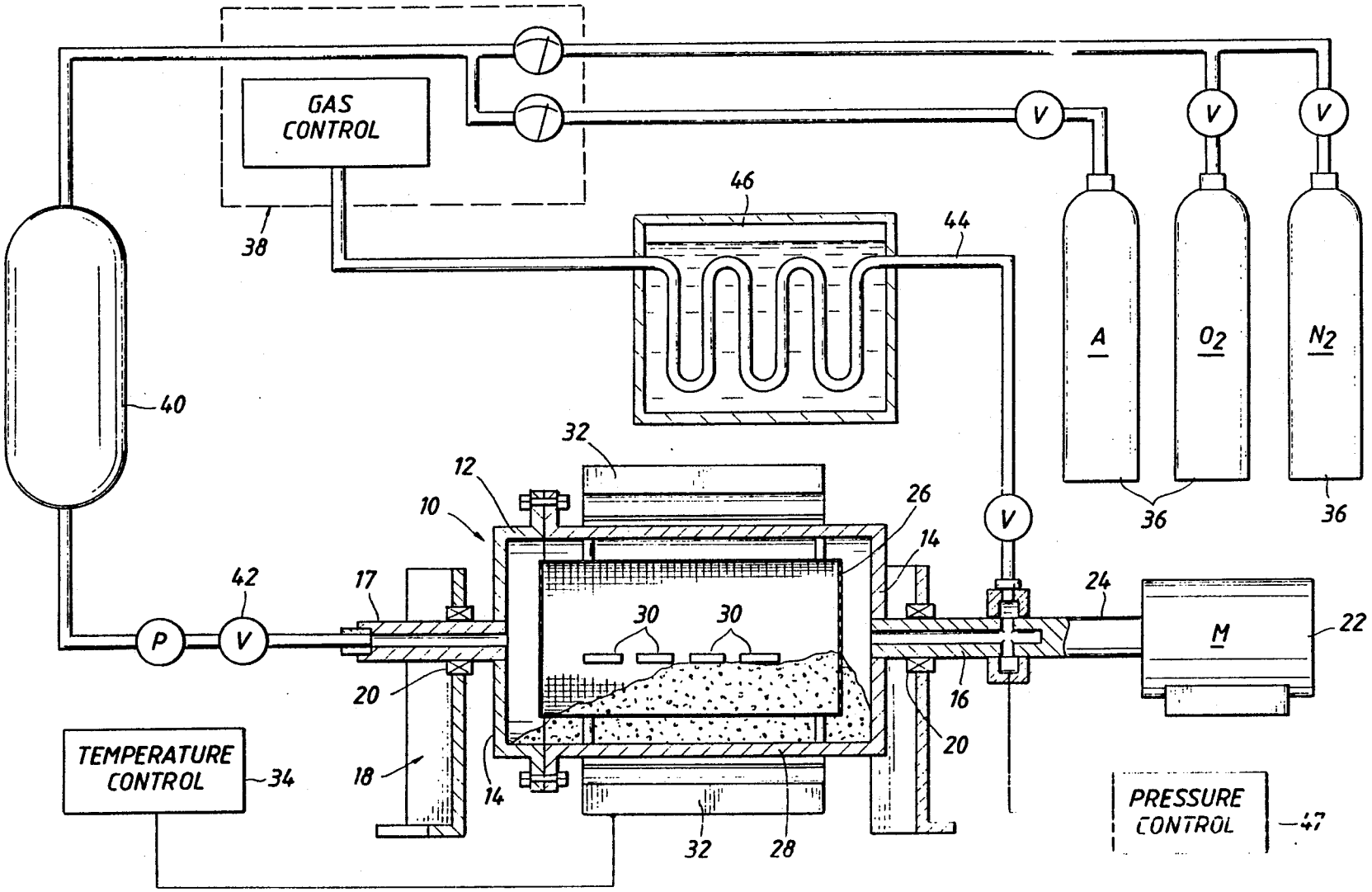
FIG. 3 is schematic of one embodiment of the heat transfer apparatus of this invention including a rotary container having particulate material and workpieces therein.

Referring to FIG. 1, a graph shows the relationship of gas flow in a conventional prior art fluidized bed of pulverulent material containing workpieces immersed in the fluidized bed with heat transferred to the workpieces from the upward flow of gas through the pulverulent or particulate material. Fluidized beds of pulverulent particles or particulate material in the range of 500 microns or less provide a very rapid rate of heat transfer to and from metal workpieces immersed in the bed. It is noted that the heat transfer to the workpieces increases as the motion of the particles increases from fluidizing. However, when the motion or movement of the particles increases from the increase in the gas flow rate beyond a specific range, the heat transfer or flow rate between the particles and the workpieces decrease substantially. Thus, an optimum range for the motion or speed of the particulate particles exists and an excessive rate of fluidizing is not desirable in order to obtain the optimum rate of heat transfer.

It has been found that the rate of heat transfer by a fluidized bed to and from the workpieces is generally independent of gas flow and is dependent on the rate of movement of the fluidized particles about the metal workpieces. The fluidized particles provide a relatively large surface area which contacts the metal workpieces for the transfer of heat therebetween. The motion of the particulate material can be easily controlled by the movement of the container in which the particulate material and workpieces are positioned. The mechanical movement of the container effects a constant random motion of the particulate material within the container and against the workpieces in the container. The container may be either heated or cooled by external heating means, for example, and the particles rapidly transmit the heat between the vessel wall and the workpieces so that an operator may precisely follow a predetermined temperature time cycle.

Fluidizing is defined herein as the placement of a mass of particles in a fluid like state and is obtained by the present invention by a mechanical agitation of a container having workpieces immersed in a bed of particulate material in the container thereby to create continuous relative motion between the workpieces and particulate material which is fluidized by relative motion. Heating of the workpieces is obtained by heating the container and a heat transfer is obtained between the container and the workpieces by utilizing the fluidized particulate material as the transfer medium.

Referring to FIG. 2, the graph provides a comparison of the cooling rates of similar workpieces resulting from (1) air cooling under ambient conditions (2) gas fluidizing without movement of the container and (3) fluidizing from rotary motion of the container having the particulate material and immersed workpieces therein. It is noted that very high heat transfer rate is achieved by rotary movement of the container which is substantially higher than the heat transfer achieved by gas fluidizing or air cooling.

Referring now particularly to FIG. 3, one embodiment of the apparatus of this invention is illustrated for heating workpieces, such as refractory metal workpieces, in a rotating container shown generally at 10. Container 10 comprises an outer cylinder 12 having ends 14 secured to stub shafts 16 and 17. A support generally indicated at 18 has bearings 20 mounting stub shafts 16, 17 for rotation. A motor 22 has a drive shaft 24 for rotating stub shafts 16, 17 and cylinder 12. Outer cylinder 12 has a wire mesh basket 26 mounted therein and filled to around fifty (50) percent of its volume with particulate or pulverulent material such as metal shot particles for example of a diameter of around 125 microns (0.005 inch), and indicated at 28. Workpieces 30 are positioned within basket 26 in contact with the shot particles 28. Electrical heating units shown at 32 are provided for heating the wall of cylinder 12 to a predetermined temperature during rotation of cylinder 12 for fluidizing. Under certain conditions it may be desirable to heat the wall of cylinder 12 to the predetermined temperature prior to the tumbling operation. A suitable heater control 34 is utilized for obtaining the desired temperature for heating the cylindrical wall of cylinder 12. The transfer of heat from cylinder 12 to workpieces 30 for heating of workpieces 30 is achieved through the particulate material 28 which acts as the heat transfer medium. The rotation of container 10 effects fluidizing of particulate material 28 and the relatively large surface area of the particulate material in contact with the outer surface of workpieces 30 provides an efficient transfer of heat between cylindrical container 10 and particulate material 28.

While workpieces formed of various metals may be heated within container 10, the method has been particularly useful for workpieces formed of a refractory metal, such as zirconium or titanium, for example. Also, while the particulate material may be formed of various metallic particles, particulate material formed of an oxide of the same material of the workpieces, such as zirconium oxide particles for zirconium workpieces and titanium oxide particles for titanium workpieces, has been found to be highly effective in the transfer of heat between the workpieces and the container. Palladium, niobium or compound particles thereof may be used as a fluidized bed material particularly with titanium workpieces and palladium or niobium ions are infused into the surface of the titanium workpiece to form an outer alloy case of titanium with palladium or niobium.

Heat may be efficiently transferred between workpieces 30 and container 10 without the introduction of gas within container 10 it may be desirable to introduce gas within container 10 during the fluidizing of the particulate material resulting from rotation of container 10 and tumbling of workpieces 30 within container 10. When desired, a selected gas, such as an inert gas, nitrogen, or oxygen, may be introduced within container 10 during the tumbling and/or during heating. Suitable argon, nitrogen, and oxygen cylinders 36 are controlled by a gas control device at 38 to provide the desired percentage of nitrogen or oxygen in the inert argon carrier gas. The desired gas is supplied through expansion chamber 40, supply line 42, and hollow stub shaft 17 to container 10. The gas exits through hollow stub shaft 20 and outlet line 44 to a cooling bath at 46 for return to control device 38 and supply line 42. Control device 38 includes a gas analyzer and flow meters to maintain the desired flow and percentages of predetermined desired gases to cylinder 12. If desired to maintain the enclosed volume defined by container 12 at a predetermined negative or positive pressure, a pressure control is shown generally at 47. A vacuum pump may be utilized for providing a vacuum. Positive pressures as high as 60 psi have been utilized particularly for increasing the depth of hardening the outer case of workpieces. Pressures as high as around 1,500 psi or more, may be desirable under certain conditions. A negative pressure may be utilized for heat treating and negative pressures of below 1 psia have been employed satisfactorily.

It may be desirable under certain conditions to tumble workpieces 30 before heating so that a smooth finish is obtained prior to the heating in a cold forming or peening operation. With workpieces 30 comprising valve members, for example, the peening or cold forming operation reduces grain size by a factor of at least 3 for a depth of at least 50 microns (0.002 inch) and in some instances the grain size may be reduced of a factor of 25 to 30. After cold working, cylinder 12 is heated an amount sufficient for heating the workpieces to a temperature of at least 1200 F. and preferably around 1350 F. When utilizing zirconium workpieces, a hard outer layer of a gray color is sometimes obtained when zirconium workpieces are first cold worked.

It is desirable to have a controlled atmosphere within container 10 with inlet 17 permitting a predetermined gas within container 10 and outlet 16 permitting the discharge or exit of gas from container 10. Also, it is desirable under certain conditions to provide a vacuum or positive pressure. For example, when utilizing nitrogen such as necessary for a nitriding operation for hardening the outer surface of a workpiece, the nitrogen is entrained in a carrier gas, such as argon, and the nitrogen pressure is much smaller than the argon pressure, such as one (1) percent of the argon pressure. Nitrogen utilized in the rotary fluidized bed of the present invention may be less than around 0.15 psi, for example.

Cooling coils may be provided externally of the cylindrical wall to obtain a very fast cooling rate in the fluidized bed. It is believed that a rotary fluidized bed in accord with the present invention provided with cooling coils could effect an austempering effect for various materials by cooling the various materials or workpieces which have been heated to a temperature of around 1600 F. or above, to a temperature around 600 F. to 1100 F. which is a normal temper region for various materials. The present invention may be also used for the austempering of ductile iron workpieces.

Thus, it is believed that the present invention may be used for heat treating under a vacuum or a controlled atmosphere condition for annealing, quenching and tempering, austempering, stress relief, aging, and solution treating with the result of changing the character of the base material generally through hardness, strength, and ductility.

In addition, the present invention may be utilized with the diffusion of ions such as nitrogen, oxygen, boron, carbon, and silicon into the surface of metals for forming nitrides, oxides, borides, and other intermetallic compounds that modify the surface of the base material or metal of the workpieces. The surface compounds have various advantages, such as corrosion resistance, abrasive resistance, or appearance advantages. The ions are generally introduced into the process through a gas provided within the container or in the form of various compounds used as the particulate bed material in the container.

Metal workpieces, such as refractory metals including zirconium or titanium, for example, have been utilized in accordance with the present invention in which heat transfer and fluidizing were achieved by the utilization of a rotating cylindrical container. The container included a bed of particulate material having a medium size less than around 900 microns filling around fifty (50) percent of the volume of the container with the metal workpieces embedded in the particulate material. The cylindrical wall of the container for heating of the workpieces was heated by an external electrical heating unit with the heat transferred by the particulate material to the workpieces during fluidizing obtained by rotation of the cylindrical container. Thus, heat transfer and fluidizing were achieved by the rotating container including a bed of particulate material having workpieces embedded therein and with the random motion of the particulate material created by rotation of the container and the heat transfer being effected through contact of a relatively large surface area of the particulate material with workpieces to provide a very high rate of heat transfer.

The container of the present invention has a diameter of about ten inches and may be operated at around 20 rpm. In the event the diameter of the container is increased, then the rpm rate would likewise be decreased so that the generally similar speed of movement of the outer wall of the container and the workpieces and fluidized material within the container is obtained. Thus, for a container having a diameter of around sixteen inches, a rotational speed of around 15 rpm would be provided giving a linear speed for the wall of the container of around sixty (60) feet per minute. In regard to the particle size of the particulate material utilized within the container, a particle size of around 100 microns has been found to be effective with workpieces having a size of around three or four inches in length, for example. A relatively large particle size of around 600 to 900 microns is capable of being fluidized under certain conditions and may be utilized in the present invention. The type of particulate material and the size of the workpieces along with the rotational speed of the container are factors which determine the particle size for obtaining fluidizing.

As a specific example, titanium workpieces were positioned within a container having ceramic beads formed of zirconium oxide with a medium diameter of around 100 microns. The container was filled to around fifty (50) percent of its capacity or volume with the ceramic beads. The cylinder was rotated at a speed of twenty-eight (28) rpm to obtain fluidizing of the ceramic beads. The cylinder was heated by external electrical heating units as shown in FIG. 1 to a temperature of around 1500 F. It was desired to have the titanium workpieces nitrided and a pure argon gas flowed through the cylinder at a rate of two (2) standard cubic feet per hour with a one-half (½) percent nitrogen added to the argon carrier gas. The cylinder along with the workpiece and ceramic beads was heated to 1500 F. for around nine hours. After heating, the external heat source was removed and the cylinder cooled under ambient conditions. As a result, a hardened nitrided surface was provided on the titanium workpieces.

One test program provided for the creation of an oxide film and case hardened layer on zirconium. For this program, the container or retort was filled sixty (60) percent full with zirconium oxide beads, about 100 micron size. Zirconium parts or workpieces were fixed in the container so that during a portion of each cycle, beads cascaded over the zirconium workpieces. The container was sealed and filled with a gas containing four (4) percent pure oxygen in an argon carrier gas. A pressure of 20 psi gauge was created in the container and approximately one (1) standard cubic foot per minute of gas was simultaneously fed into the container and bled out of the container to maintain the desired pressure. The container was rotated alternately in one direction and then the other. The entire assembly was heated to 1400 F. and maintained for a period of two hours.

At the conclusion of the heating period the gas was changed to pure argon to provide cooling. The treated workpieces exhibited a hard black coating of zirconium oxide with an underlying case of zirconium interstitially alloyed with oxygen.

In another test a nitrogen alloyed hard case was provided on titanium workpieces. The container was filled about sixty (60) percent full with 304 SS (stainless steel) beads. The titanium workpieces were placed within the beads and were allowed to mix freely with them. A gas mixture of ten (10) percent nitrogen, ten (10) percent hydrogen and eighty (80) percent argon was introduced in the container at the rate of about 2 cfm to create a pressure of about 20 psi. The entire container was heated to 1300 F., held for a period of six hours, and then cooled. The titanium workpieces after treatment had a titanium nitride surface coating and a thin layer of interstitially alloyed nitrogen and titanium.

Figure 6:
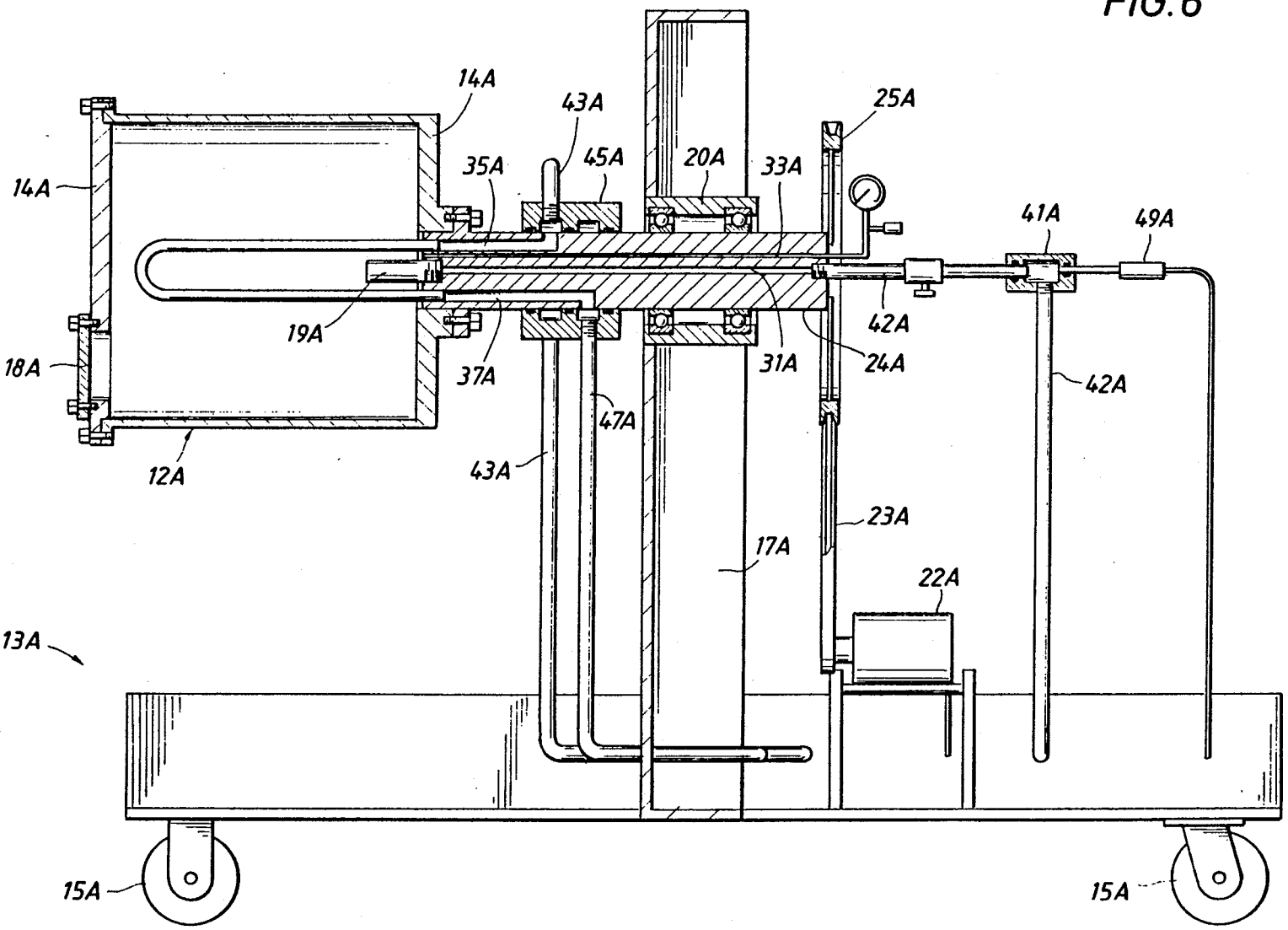
FIG. 6 is a side elevation, partly in section, of the rotary container shown in FIG. 5 and including means for cooling the container.

Referring to FIGS. 4–6 another embodiment of an apparatus in accord with this invention is illustrated. A box-type heating compartment is shown generally at 10A supported in a generally stationary position on a supporting floor. Heating compartment 10A is generally of a cube shape having an open side at 11A. Electrical heating units 32A are mounted along selected sides of compartment 10A and have a source of electrical energy connected thereto at 33A. A movable support frame shown generally at 13A has rollers 15A for rolling movement along the supporting floor and adapted to be selectively inserted within and removed from compartment 10A.

Mounted on closure wall 17A is a cylindrical container or retort generally indicated at 12A having inner and outer ends 14A. Outer end 14A forms a cover which may be removed for the positioning of workpieces and particulate material within the container. Outer end 14A has an opening covered by a small removable cover plate 18A also to permit the particulate material to be added to container 12A. Under certain conditions, it may be desirable to provide a frangible disc in cover plate 18A to act as a safety feature in the event of high pressures within container 12A.

For rotation of container 12A, a shaft 24A is secured to inner end 14A and mounted for rotation in bearings of hub 20A supported by closure wall 17A. To rotate shaft 24A, a motor 22A drives a pulley belt 23A extending about pulley 25A secured to shaft 24A. Shaft 24A is hollow and has at least four separate bores therein. A central bore 31A is provided for the supply of a suitable gas, if desired, to container 12A through a filter 19A and bore 33A is provided for the discharge or removal of gas from container 12A to atmosphere. A bore 35A is provided for the supply of a cooling fluid, such as air or water, to container 12A and a bore 37A is provided for the discharge or removal of the cooling fluid from container 12A. The gas removed from container 12A through bore 37A is exhausted to atmosphere by manually operated control valve 39A. Gas supplied through bore 31A is from a fixed supply line 42A through a rotary inlet at 41A which rotates with shaft 24A.

To supply cooling fluid to bore 35A, a fixed cooling fluid supply line 43A extends to a rotary seal 45A about shaft 24A which is in fluid communication with bore 35A. For removal of cooling fluid from bore 37A, a fixed exhaust line 47A is connected to rotary seal 45A to receive fluid from bore 37A. An electrical commutator seal is shown generally at 49A and may be utilized to monitor and record the temperature within container 12A.

Various gaseous or liquid fluids, such as air or water, may be provided for cooling the interior of container 12A. It may be desirable under certain conditions to combine mixtures of air and water. For example, air may be initially supplied to container 12A for a predetermined period of time, and then water may be added in selected percentages as desired.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Heat transfer apparatus for transferring heat through particulate material to and from workpieces contacting the particulate material; said heat transfer apparatus comprising:
   - an enclosed substantially fluid tight container having the particulate material therein and including;
   - at least one workpiece contacted by particulate material within the enclosed container with the workpiece and particulate material occupying a substantial portion of the internal volume of said container;
   - means to vary the temperature of said container;
   - means to rotate said container to effect fluidizing of said particulate material to provide relative motion between the workpiece and particulate material over substantially the entire surface area of the workpiece to effect a transfer of heat between the workpiece and particulate material; and
   - means to control precisely the pressure within said enclosed fluid tight container.

2. Heat transfer apparatus as set forth in claim 1 wherein said means to vary the temperature of said container comprises means to heat said container to effect a heat transfer from said container to said workpiece through said particulate material when fluidized from movement of said container.

3. Heat transfer apparatus as set forth in claim 1 wherein said means to vary the temperature of said container comprises cooling means to effect a heat transfer from said workpiece to said particulate material when fluidized from movement of said container.

4. Heat transfer apparatus as set forth in claim 1 wherein means are provided to permit the entry of an inert carrier gas and an active gas within the container; and
   - means are provided to permit the exhaust of the gases from the container.

5. Heat transfer apparatus comprising:
   - an enclosed substantially fluid tight container of a generally cylindrical shape;
   - at least one workpiece within said container adapted to be treated for obtaining a temperature over the 800 F.;
   - particulate material within the enclosed container for contacting the workpiece with the workpiece and particulate material occupying a substantial portion of the internal volume of said container;
   - means to permit the entry of gases within the enclosed container;
   - means to permit the exhaust of the gases from the enclosed container;
   - means to vary the temperature of said container to a predetermined amount; and
   - means to rotate said container about a generally horizontal axis to effect random motion between the workpiece and particulate material over substantially the entire surface area of the workpiece to effect a transfer of heat between the workpiece and particulate material.

6. Heat transfer apparatus as set forth in claim 5 wherein said means to vary the temperature of said container comprises heating means to effect a heat transfer from said container to said workpiece through said particulate material when fluidized from movement of said container.

7. Heat transfer apparatus as set forth in claim 5 wherein said means to vary the temperature of said container comprises cooling means to effect a heat transfer from said workpiece to said container through said particulate material when fluidized from movement of said container.

8. Heat transfer apparatus as set forth in claim 5 wherein means are provided to control the pressure within said enclosed container.

9. A method for transferring heat to and from a workpiece in an enclosed fluid tight container comprising the following steps:
   - providing particulate material within a substantial portion of the volume of the container for contacting the workpiece;
   - controlling the pressure in the interior of said container;
   - heating the container to a temperature over around 800 F.; and
   - rotating the container with the particulate material and workpiece therein at a speed sufficient to fluidize the particulate material for transferring heat between the container and the workpiece through the fluidized particulate material.

10. The method as set forth in claim 9 further including the steps of:
   - supplying a gas to said enclosed container; and
   - exhausting the gas from said enclosed container.

* * * * *